US007134859B1

(12) United States Patent
Sørensen

(10) Patent No.: US 7,134,859 B1
(45) Date of Patent: Nov. 14, 2006

(54) NITS SEPARATOR

(75) Inventor: Birger Elmgaard Sørensen, Vejle (DK)

(73) Assignee: M&J Fibretech A/S, Horsens (DK)

( * ) Notice: Subject to any disclaimer, the term of this patent is extended or adjusted under 35 U.S.C. 154(b) by 0 days.

(21) Appl. No.: 09/743,589

(22) PCT Filed: Jul. 13, 1999

(86) PCT No.: PCT/DK99/00401

§ 371 (c)(1),
(2), (4) Date: Jan. 24, 2003

(87) PCT Pub. No.: WO00/04232

PCT Pub. Date: Jan. 27, 2000

(30) Foreign Application Priority Data

Jul. 14, 1998 (DK) ..... 1998 00933

(51) Int. Cl.
*B27N 3/04* (2006.01)

(52) U.S. Cl. ..... 425/82.1; 425/83.1

(58) Field of Classification Search ..... 425/82.1, 425/83.1, 217; 264/121, 518
See application file for complete search history.

(56) References Cited

U.S. PATENT DOCUMENTS

| | | | | |
|---|---|---|---|---|
| 2,940,134 | A * | 6/1960 | Heritage | 264/518 |
| 3,581,706 | A | 6/1971 | Rasmussen | |
| 4,004,324 | A * | 1/1977 | Bridge et al. | 425/82.1 |
| 4,169,699 | A | 10/1979 | Werner | |
| 4,366,111 | A | 12/1982 | Dinius et al. | |
| 4,375,448 | A | 3/1983 | Appel et al. | |
| 4,494,278 | A | 1/1985 | Kroyer et al. | |
| 4,640,810 | A * | 2/1987 | Laursen et al. | 264/518 |
| 4,921,650 | A * | 5/1990 | Eriksson et al. | 264/37.28 |

FOREIGN PATENT DOCUMENTS

| | | |
|---|---|---|
| DK | 161343 B | 6/1991 |
| WO | WO87/03626 | 6/1987 |
| WO | WO91/05109 | 4/1991 |

* cited by examiner

*Primary Examiner*—Donald Heckenberg
(74) *Attorney, Agent, or Firm*—Winston & Strawn LLP

(57) ABSTRACT

A plant which serves to produce a nonwoven web of fibers out of a fibrous material, such a cellulose pulp. The plant comprises a hammer mill for defibrating the fibrous material and a forming head for forming a web of fibers on an endless forming wire, which, during operation, runs mainly horizontally, a first transport fan for transporting defibrated fiber to the forming head via a first air duct and a second transport fan to extract nits from the forming head via a second air duct. Furthermore, the plant comprises a separator, which is connected to the second air duct and arranged for separating the nits and the well-opened fiber, a third transport fan for returning the separated, well-opened fibers to the forming head, and a nits-opener for converting the separated nits into well-opened fiber. The separated nits are transported from the nits separator to the nits-opener by means of a fourth transport fan via a fourth air duct. The defibrated fibers are returned to the forming head by means of a fifth transport fan via a fifth air duct. The plant is easy to control and is capable of producing optimally high quality fiber products. In addition, the plant allows the defibrator to defibrate new fiber material at full capacity so that the remainder of the plant is able to produce at an optimum output level. The plant is furthermore very energy-saving.

18 Claims, 1 Drawing Sheet

NITS SEPARATOR

FIELD OF THE INVENTION

The invention relates to a plant for producing a nonwoven fibre web out of a fibrous material and which comprises a defibrator, such as a hammer mill, for forming the fibre web on a endless forming wire which, when in operation, mostly runs horizontally, a first transport fan which transports defibrated fibres via a first duct to a forming head, and a second transport fan which extracts nits from the forming head.

Nits are knots, which occur in the defibrated fibrous material as a result either of incomplete defibration in the defibrator, during transport to the forming head or during the processes which take place within the forming head.

Nits impair the quality of the finished fibre product. Conventionally, the nits are removed by extracting them from strategic locations within the forming head and returning the extracted material to the hammer mill where the nits are opened to singular fibres and then returned to the forming head.

Achieving a sufficiently high quality finished fibre product presupposes that all the nits are extracted. However, this requires such an efficient extraction that extraction of a significant amount of well-opened fibres is inevitable. This means that, in practice, by far the greatest part of the extracted material consists of well-opened fibres.

To ensure that the nits are entirely removed, the total quantity of extracted fibre material is large and the defibrator is thus subjected to significant extra load.

The extra load, which may account for up to 50% of total power consumption, thus significantly reduces the defibrator's useful capacity to defibrate new fibre material.

The defibrator is often a bottleneck in any given plant and, where this is the case, the above-mentioned reduction in the useful capacity of the defibrator prevents 100% utilization of the remainder of the plant. The total operating costs are increased correspondingly.

The large quantity of re-circulated fibre material in itself causes great wear and tear on the defibrator. Furthermore, practical experience has shown that the fibre material does not flow evenly across the whole width of, for example, a hammer mill but tends rather to concentrate in certain areas around the rotor, gradually wearing traces in the rotor which must then be repaired.

Another disadvantage connected to the above-mentioned conventional method for removing nits from the forming head and convert them in the defibrator is that large quantities of well-opened fibre travelling through the process alongside the nits are shortened to some degree during the defibration process, thus diminishing the quality of the finished fibre product.

The air streams, which transport fibre material around the plant, form a unified system, which is difficult to control.

As mentioned above, the fibrous material containing nits extracted from the forming head is transported back to the defibrator where it is treated along with new material. At the end of this process, the extracted material is transported back to the forming head on the same air stream as the new fibre material. This air stream is constantly supplied with fresh air sucked into the defibrator, which works therefore under negative pressure. At the same time, air is sucked out of the forming head via the forming wire.

The system concerned is therefore an interconnected system in which extraction from the forming head can easily be disrupted by changes to the hammer mill parameters. This is due to the fact that the negative pressure in the hammer mill changes correspondingly. A change to these operative parameters demands a great deal of adjustment in order to ensure that the plant always is acting optimally.

BACKGROUND ART

From the patent application WO 8703626 A1 is known a plant for producing nonwoven web of fibres by air laying the fibres by means of a forming head. The fibres are by a fan transported from a defibrator to the forming head via a conduit.

The main current form the defibrator to the forming head is passing a screen for separating nits from acceptable fibres.

Therefore, the screen needs to have very large dimensions for being able to treat such large quantities of material. The invested capital in a plant of WO 8703626 A1 therefore of necessary will be rather high.

Also, the process of this known plant is uneconomical because the large quantities of energy, which need to be used for driving the main current through the large screen for only separating the few percent of nits in the main current.

The quality of the resulting product from a plant according to WO 8703626 A1 also will be poor as the nits in this plant are separated from a large current having a low percent of nits, as in D1.

Moreover, it is not possible to obtain a product which is essential free from nits when trying to separate nits in the main current, as nits afterwards are produced during the pneumatic transport to the forming head and during the process in this.

When separation the nits from the main stream not only nits are separated but also well-opened fibres are separated and that in a quantity, which will be much larger than the quantity of the separated nits. These separated well opened fibres are together with the separated nits returned to the defibrator subjecting this to heavy load. As the defibrator normally is the bottleneck of the plant said draw back results in that the difibrator need to be dimensioned with an oversize. That means that the plant of D1 also by this reason will be more costly in investment and more costly to operate than a similar plant according to the present invention.

Furthermore, the well-opened fibres, which are returned to the defibrator will be shortened whereby the fibre product will obtain a poor quality.

SUMMARY OF THE INVENTION

A first object of the invention is to provide a plant of the kind mentioned in the opening paragraph, which can function with lower energy consumption than hitherto known.

A second object of the invention is to provide a plant of the kind mentioned in the opening paragraph, which better than hitherto known is able to produce a high quality product without nits and shortened fibres.

A third object of the invention is to provide a plant of the kind mentioned in the opening paragraph, which is easier to keep in a controlled condition than hitherto known.

A fourth object of the invention is to provide a plant of the kind mentioned in the opening paragraph which is arranged in such a way that the load on the defibrator is more even, that the defibrator is subjected to less wear and tear and that its capacity is utilised more efficiently than hitherto known.

What is new and characteristic of the invention and ensures that these improvements are achieved is that the plant also includes a separator, connected to the second air duct, for separating nits and well-opened fibres.

This arrangement ensures that the large quantities of nits and defibrated fibres extracted from the forming head are channelled past the defibrator, which can then be utilised exclusively for defibration of new material. This saves the energy used by conventional plants to treat the extracted material in the defibrator. Furthermore, the defibrator is allowed to work with a constant, even load and is not subject to the kind of wear and tear to which, for example, a hammer mill rotor has hitherto been subjected.

As at least some of the well-opened fibres are conveyed past the defibrator and do not come into contact with the airborne stream of defibrated fibrous material in it, the air stream in the plant are more easily controlled, avoiding the disadvantages associated with adjusting conventional plants.

One further advantage is that the finished fibre product achieves optimum high quality, because the fibres are not shortened by the defibrator, and in consequence of that, all the nits are in addition sucked up without causing load on the defibrator with the large quantities of well-opened fibres which are extracted along with the nits when a complete nits extraction is sought.

The separated, well-opened fibres may be collected in a suitable way for later use. However, this material can with advantage be returned to the forming head by means of a third transport fan and a third air duct.

Furthermore, the separated nits can be removed from the nits separator by means of a fourth transport fan inserted in a fourth air duct, which in one embodiment can be connected to the defibrator.

As the separated nits account only for a minor part of the fibrous material sucked away from the forming head, the advantages achieved by using a plant of the kind described in accordance with the invention can partly be maintained even if the separated nits are transported directly to the defibrator for being defribrated there.

In one advantageous embodiment the plant may include a separate nits-opener, the purpose of which is to turn the separated nits into well-opened fibres. The advantage inherent in this construction is that the defibrator is not subject to the strain of the separated nits.

In this case, the fourth air duct may extend between the nits separator and the nits-opener, which may also be connected to the forming head via a fifth air duct with a fifth transport fan for returning the opened nits to the forming head, so that, the separated nits, which are opened in the nits-opener, are channelled in a circuit past the defibrator.

The nits-opener and the nits separator can both be constructed in any suitable way. The nits-opener may, for example, be a hammer mill or, alternatively, a refiner to defibrate the nits either between two grinding discs or on a card. The nits separator may be a forming head, a cyclone or an air screen.

BRIEF DESCRIPTION OF THE DRAWING

The invention will be explained more fully by the following description of an embodiment, which just serves as an example, and with reference to the FIG. 1.

BRIEF DESCRIPTION OF THE PREFERRED EMBODIMENT

Figure 1:
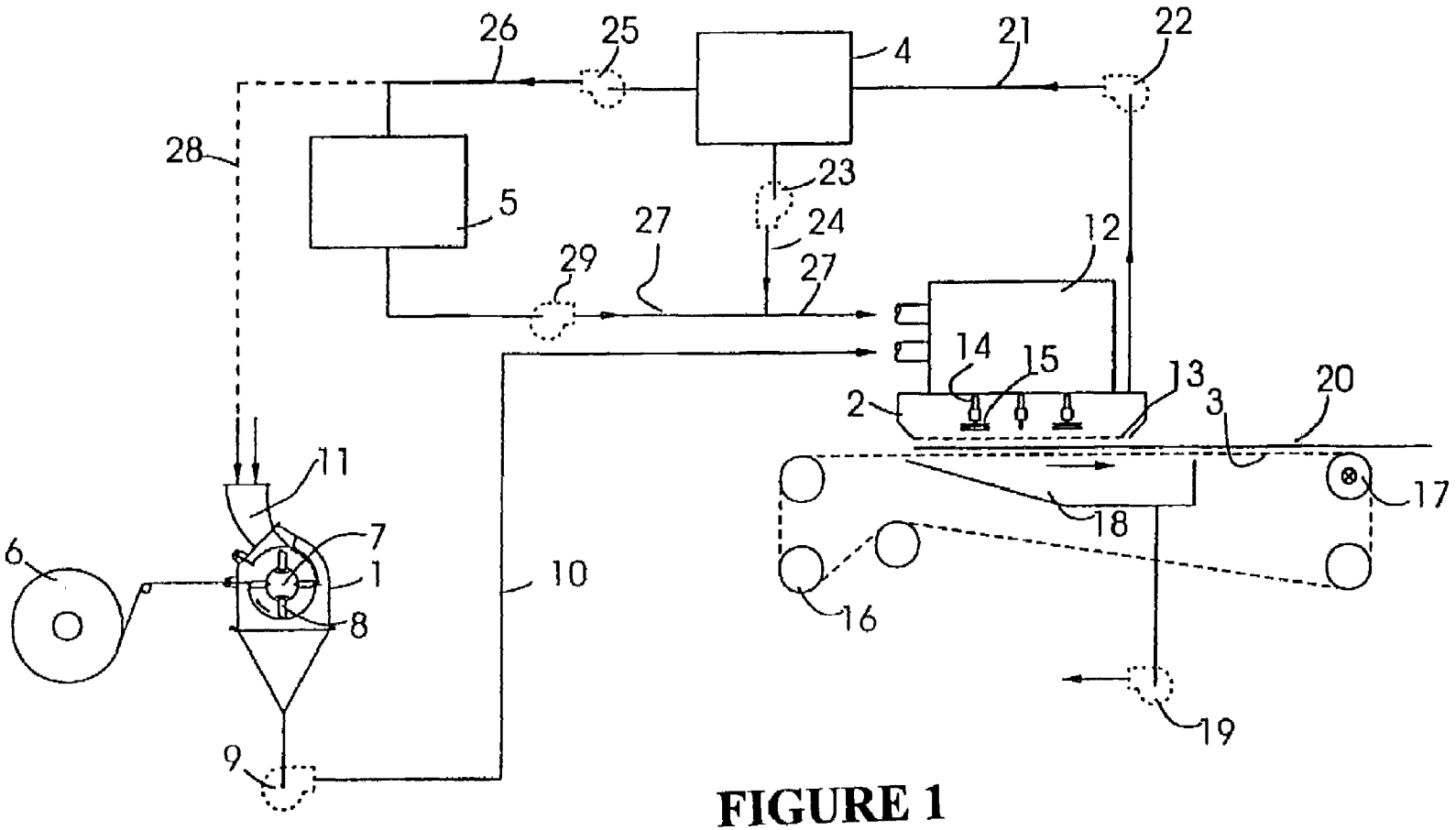

The plant includes a number of transport fans. These are drawn with dotted lines to indicate that one or several of these transport fans may be omitted in special variations of the construction shown.

The main components of the plant in the case shown in FIG. 1 are a known hammer mill 1, an existing forming head 2, and existing forming wire 3, which is mounted underneath the forming head, a nits separator 4 and a nits-opener 5.

Fibre material, which in this example is assumed to be cellulose pulp, is fed to the hammer mill 1 on a roller 6. The pulp is, in a known way, defibrated into single fibres in the hammer mill by means of a rotor 7, which has hinged swingles 8 and is rotating during operation.

By means of a first transport fan 9 and via a first duct 10, the fibres are channelled to the forming head 2 on an air stream, which is formed as the hammer mill, in the direction of the arrow, is supplied with air via an air intake 11.

The forming head 2 shown comprises mainly a housing 12 with a perforated base 13 and a number of rotors 14 with wings 15 mounted above the base.

The forming wire 3 comprises an endless, air permeable belt which runs over a number of idle rolls 16, which in the example shown are four, and a driving roll 17. A suction box 18 is mounted underneath the forming wire with a fan 19 to create a negative pressure in the suction box.

During operation, the fibres supplied to the forming head 2 over the perforated base 15 are distributed by means of the wings 15 on the rotating rotors 14.

The negative pressure in the suction box 18 generates a stream of air across the base and forming wire 2. This stream of air gradually pulls the fibres down onto the forming wire via the openings in the perforated base 13.

The forming wire will normally consist of a mesh net whose mesh size ensures that the majority of the fibres form a web 20 on the upper side of the forming wire while the air streams past into the suction box 18.

The forming wire transports the web of fibres further along in the direction indicated by the arrow for treatment in the later stages of the process in the plant (not shown).

Nits are knots in the defibrated fibre material, formed in the hammer mill during transport to the forming head and during the process, which takes place there. The nits diminish the quality of the finished fibre product and are therefore removed from the forming head in the normal way via a second air duct 21 with a second transport fan 22.

A high quality of the finished fibre product requests that the product contains no nits at all, which is why the nits must be removed completely from the forming head before they reach the point at which they are swept along by the air stream through the base of the forming head.

A strong air stream is needed for efficient extraction of the nits. This strong air stream will unavoidably also suck away large quantities of well-opened fibres at the same time. In practice, significantly more well-opened fibres is sucked up through the second air duct 21 than nits.

The nits and the well-opened fibres are channelled via the second air duct 21 to the nits separator 4. This separator may, for example, be a small forming head (not shown) which can easily be adjusted for this specific purpose.

It is an advantage if the extraction beneath the forming head is just strong enough to ensure that the nits are separated with an optimum concentration of nits in the extracted material. Strong suction may mean that there is a small quantity of nits in the mass of separated well-opened fibres. This is; however, not crucial as the nits are again caught in the forming head and subsequently once more subjected to the separation process in the nits separator.

Alternatively, the nits separator may, however, be a cyclone (not shown) or an air separator (not shown).

The separated, well-opened fibres are removed from the nits separator by means of a third transport fan 23 and are returned to the forming head via a third air duct 24 without being shortened or otherwise damaged like in a conventional plant.

The separated nits are extracted from the nits separator by means of a fourth transport fan 25 via a fourth air duct 26, connected to the nits-opener 5. The nits-opener may, for example, be a small hammer mill (not shown) or a refiner (not shown) to defibrate the nits between two grinding discs or on a card (not shown).

Having been opened in the nits-opener, the now well-opened fibres are channelled back to the forming head 2 via a fifth air duct 27 by means of a fifth transport fan 29. In the drawing the third and fifth air ducts 24;27 are joined at their connection to the forming head. These two air ducts 24;27 may alternatively be separately connected to the forming head (not shown).

An air duct 28, shown with dotted lines, indicates that the hammer mill 1 may be used to defibrate the nits instead of the nits-opener 5, which is then superfluous. This solution may be advantageous in cases where there is excess capacity in the hammer mill, as the level of required investment is correspondingly reduced.

The above description and drawing of the invention are based on a plant which comprises one hammer mill 1, one forming head 2, one forming wire 3, one nits separator 4 and one nits-opener 5.

However, within the scope of the invention, the plant may have any suitable number of the above-mentioned components nos. 1, 2, 3, 4 and 5 and in any combination.

The defibrator does not necessarily have to be a hammer mill but may equally well be any other kind of suitable defibrator.

Furthermore, the plant can be constructed to pre-treat not only cellulose fibre but also other fibrous materials or a mixture of these.

The invention claimed is:

1. A plant for producing a nonwoven web of fibers of fibrous material which comprises a device for defibrating fiber material, at least one head for forming a fiber web on a endless forming wire which, during operation, runs mainly horizontally, a first transport fan for transporting defibrated fibers to the forming head via a first air duct, a second transport fan to extract nits from the forming head via a second air duct, a separator, connected to the second air duct, for separating nits and well-opened fibers; and a nits-opener to convert the separated nits into well-opened fibers.

2. The plant of claim 1, wherein the nits-opener is a hammer mill.

3. The plant of claim 1, wherein the nits-opener is a refiner, designed to defibrate the nits between two grinding discs.

4. The plant of claim 1, wherein the nits-opener is constructed in the form of a card.

5. The plant of claim 1, which further comprises a third transport fan for returning the separated, well-opened fibers to the forming head via a third air duct.

6. The plant of claim 5, which further comprises a fourth transport fan to remove the separated nits from the nits separator via a fourth air duct.

7. The plant of claim 6, wherein the fourth air duct extends between the nits separator and the nits-opener and is connected to the forming head via a fifth air duct with a fifth transport fan for returning the opened nits to the forming head.

8. The plant of claim 1, wherein the defibrating device comprises a hammer mill.

9. The plant of claim 1, wherein the nits separator is a forming head.

10. The plant of claim 1, wherein the nits separator is a cyclone.

11. A plant for producing a nonwoven web of fibers of fibrous material which comprises a device for defibrating fiber material, at least one head for forming a fiber web on a endless forming wire which, during operation, runs mainly horizontally, a first transport fan for transporting defibrated fibers to the forming head via a first air duct, a second transport fan to extract nits from the forming head via a second air duct, wherein the second air duct is a separate and distinct component from the first air duct, and a separator, connected to the second air duct, for separating nits and well-opened fibers, wherein the nits separator is a cyclone.

12. The plant of claim 11, which further comprises a third transport fan for returning the separated, well-opened fibers to the forming head via a third air duct.

13. The plant of claim 12, which further comprises a fourth transport fan to remove the separated nits from the nits separator via a fourth air duct.

14. The plant of claim 11, which further comprises a fourth transport fan to remove the separated nits from the nits separator via a fourth air duct.

15. The plant of claim 11, wherein the defibrating device comprises a hammer mill.

16. A plant for producing a nonwoven web of fibers of fibrous material which comprises a hammer mill for defibrating fiber material, at least one head for forming a fiber web on a endless forming wire which, during operation, runs mainly horizontally, a first transport fan for transporting defibrated fibers to the forming head via a first air duct, a second transport fan to extract nits from the forming head via a second air duct, and a cyclone, connected to the second air duct, for separating nits and well-opened fibers.

17. The plant of claim 16, which further comprises a third transport fan for returning the separated, well-opened fibers to the forming head via a third air duct.

18. The plant of claim 17, which further comprises a fourth transport fan to remove the separated nits from the nits separator via a fourth air duct.

* * * * *